United States Patent [19]

Nilsson

[11] 4,226,109

[45] Oct. 7, 1980

[54] TOOL FOR THE STAMPING OF HOLES OR THE LIKE IN SHEET MATERIAL SUCH AS METAL PLATE

[75] Inventor: Sven R. Nilsson, Lövstigen, Sweden

[73] Assignee: Lindova Aktiebolag, Lindesberg, Sweden

[21] Appl. No.: 951,041

[22] Filed: Oct. 13, 1978

[30] Foreign Application Priority Data

Oct. 13, 1977 [SE] Sweden ..... 7711530

[51] Int. Cl.[3] ..... B21D 28/26; B21D 31/06

[52] U.S. Cl. ..... 72/412; 7/158; 72/453.15; 72/464

[58] Field of Search ..... 72/412, 324, 464, 404, 72/453.15; 30/241; 113/54; 7/158

[56] References Cited

U.S. PATENT DOCUMENTS

| | | | |
|---|---|---|---|
| 1,258,206 | 3/1918 | Fetcher | 72/453.15 |
| 1,474,073 | 11/1923 | Dlesk | 72/464 |
| 2,343,595 | 3/1944 | Van Sittert | 72/453.15 |
| 3,777,687 | 12/1973 | Colman | 113/54 |
| 3,847,049 | 11/1974 | Bitzel | 30/241 |

*Primary Examiner*—Francis S. Husar

*Assistant Examiner*—Gene P. Crosby

*Attorney, Agent, or Firm*—Finnegan, Henderson, Farabow & Garrett

[57] ABSTRACT

The invention concerns a tool for stamping of holes or the like in sheet material, such as metal plate. The tool is mountable on a handheld motor, such as a pneumatic or hydraulic piston and cylinder motor and comprises a stationary part supported against the motor cylinder and a movable part connectable to the motor piston. The displaceable tool part has at least one slot at right angles to the direction of the motor stroke and a through drilling extends through said slot at right angles thereto at a distance from its base. The portion of said drilling at the outside of the slot is formed as a stamping die, and the portion thereof inside of the slot accommodates a stamping plunger, whose inside end engages the stationary tool part. When a piece of sheet material is inserted into the slot with its edge in engagement with the base thereof and the motor is actuated, the plunger stamps a hole in said sheet material at a fixed distance from its edge. One embodiment of the device provides a slot for deforming sheet material on one side of the tool opposite the slot for stamping.

7 Claims, 7 Drawing Figures

FIG.3a
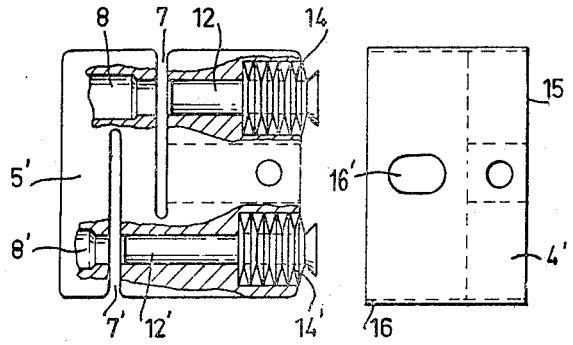
FIG.4a
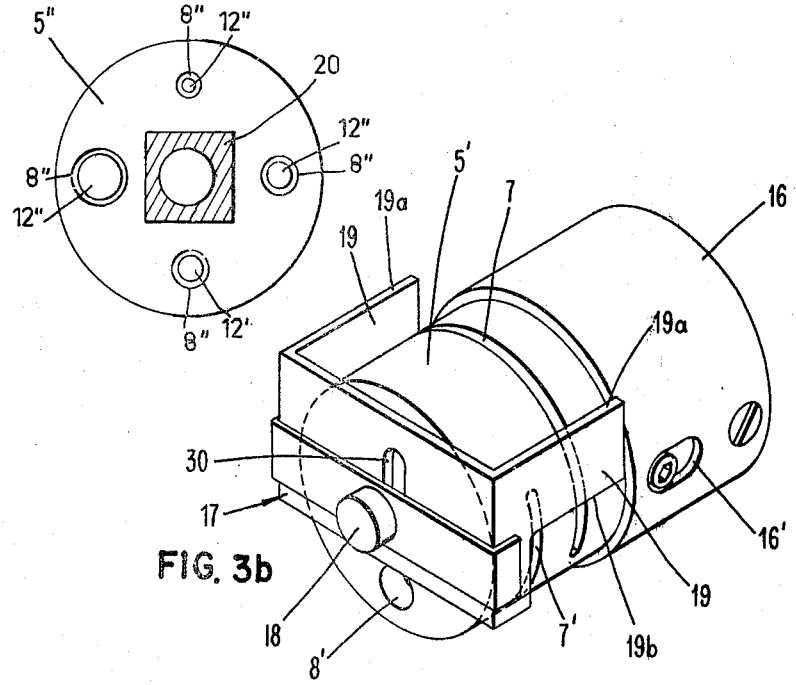
FIG. 3b

TOOL FOR THE STAMPING OF HOLES OR THE LIKE IN SHEET MATERIAL SUCH AS METAL PLATE

This invention concerns a tool for the stamping of holes or the like in sheet material, such as metal plate, said tool being intended for use in combination with a pneumatic or hydraulic piston and cylinder motor, preferably with a motor which can be held in the hand, and is comprised of a stationary part which is supported against the motor cylinder and a displaceable part which can be connected to the piston of the motor.

The main intention of the invention is to produce a simple tool by means of which a number of holes or notches can be made in the edge of a plate, whereby the distance of the holes from the edge of the plate or the depth of the notches, respectively, can be kept constant in a simple manner. The tool is especially intended for use as a hand tool and is most suitable when working with thin plate, e.g. body sheet for automobiles or the like. The tool can be produced in several embodiments, e.g. for stamping of one kind of hole of definite size and distance from the edge of the plate, or for stamping of different kinds of holes of several different sizes, shapes and distance from the edge, respectively.

It is furthermore also possible to produce the tool in such a manner that it can stamp a type of hole in the edge of the metal plate and can then permanently deform the edge of the plate before or after the hole has been made. This type is especially suitable when two plates are to be joined, when a joggling is made in the edge of one of the plates by means of the tool according to this invention, after which a number of holes are stamped with the tool in the joggled edge of the plate or in the edge of the other plate. When the edges of the plates are laid against each other, the plates can be attached to each other by means of welding or soldering in the hole which has been stamped.

The above-mentioned uses are achieved by the tool of the design which is more closely defined in the attached patent claims.

Some embodiments of the invention are described in that which follows with reference to the enclosed drawings, of which FIG. 1 shows a tool, attached to a driving motor, for the stamping of holes into and joggling of the edge of a plate.

Figure 3:
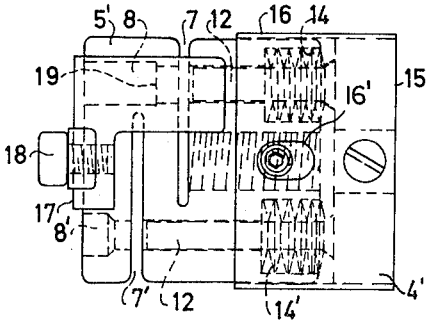
FIG. 3 shows a second embodiment of the tool according to the invention, intended for stamping holes of two different shapes, sizes and/or distances from the edge of the plate.

FIG. 3*a* is an exploded view, partly in section, of FIG. 3 with parts removed for clarity FIG. 3*b* is a perspective view of FIG. 3

Figure 4:
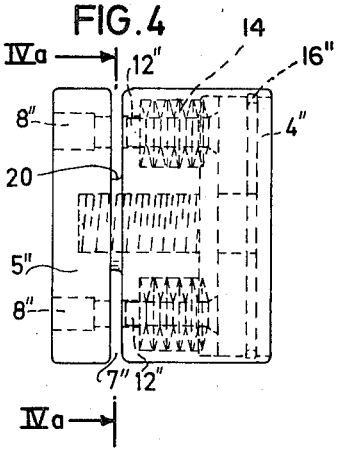

FIG. 4 shows a third embodiment of the tool according to the invention, intended for stamping holes of four different shapes, sizes and/or distances from the edge of the plate and FIG. 4*a* is a sectional view of FIG. 4 taken along the line IV*a*–IV*a* thereof.

The tool 1 according to the invention is intended to be detachably connected to the end of a driving device or driving motor 2 of generally known type, which consists of a cylinder sealed at both ends in which a piston is displaceable back and forth by means of a pressure medium, preferably air. The piston has a piston rod 3 which projects from the one end of the cylinder, and is held in the projecting position by means of a compression spring arranged in the cylinder. The motor 2 is so designed that the piston by the pressure medium is displaced inwards in the cylinder so that the piston rod 3 performs an inwardly directed relatively short working stroke, the length of which chiefly corresponds to the thickness of the metal plate which is being treated.

Fundamentally, the tool according to the invention consists of a stationary tool part 4, which is intended to rest against the flat outer end of the cylinder, through which passes the piston rod 3. In its simplest design the stationary tool part 4 can consist of a flat plate with a hole for the piston rod. The tool is also comprised of a displaceable tool part 5 which is attached to the piston rod 3, suitably by being provided with a threaded drilling into which the threaded outer end of the piston rod 3 is screwed. The displaceable tool part 5 has a flat end surface 6 turned towards the stationary tool part 4, which is situated at a distance from the stationary tool part, which chiefly corresponds to the length of the stroke of the motor 2 (see FIG. 2).

At some distance from this end surface 6, the displaceable tool part 5 is provided with a slot 7 which extends in the tool part portion chiefly at right angles to the direction of the stroke of the motor. This slot 7 is so broad that the metal plate with some play is insertable in the slot, and so deep that it stops a bit from the central threaded drilling for the piston rod 3.

The displaceable tool part 5 is furthermore provided with a through drilling 8, which is parallel to the threaded drilling for the piston rod 3 and thus parallel to the direction of stroke of the motor 2. The drilling extends through the slot 7 at right angles to same and at a distance from its base 9, which corresponds to the desired distance from the edge of the metal plate of the hole which is to be stamped. The outer part of the drilling 8, i.e. the part turned away from the motor, is constructed as a stamping die, i.e. it has a short part 10 with the same diameter as the desired hole to be stamped and is situated in direct connection to the restriction wall of the slot 7 turned towards the motor. This short part 10 in the drilling 8 continues into a longer part 10' with greater diameter, suitably over a short bevelling. The inner portion 11 of the drilling 8, which is directed towards the motor has the same diameter as the adjacent short part 10 of its outer portion. This inner portion 11 is intended to receive a stamping plunger 12 in an axially slidable manner, the outwardly turned portion of which in shape and size corresponds to the drilling portion 11 and the inwardly turned end of which shows an enlarged head with a flat end surface. A compression spring 14, suitably in the form of a packet of spring washers, is inserted between the end surface 6 of the displaceable tool part 5, and the head of the plunger 12, the flat end surface of which is intended to abut against the outwardly turned end surface of the stationary tool part 4.

When the tool 1 is affixed to the motor 2, so that the stationary tool part 4 abuts against the flat end surface of the motor cylinder and the piston rod 3 is screwed into the central threaded drilling in the displaceable tool part 5, the compression spring 14 holds the two tool parts apart, whereby the plunger 12 is totally withdrawn in the inner portion 11 of the through drilling 8 and does not protrude into the slots 7. In this position of the tool 1, a plate edge can be inserted in the slot 7 to rest against its base 9, and when the motor 2 is actuated to perform a working stroke, the piston rod 3 draws the displaceable tool part 5, in against the stationary tool part 4, whereby the plunger 12, through its end surface engaging the stationary tool part 4, is pressed into the slot 7, and in cooperation with the outer drilling portion 10, 10', formed as a stamping die, stamps a hole in the plate edge, having a distance from the edge determined by the depth of the slot 7.

The embodiments of the tool according to this invention shown in the drawings are provided with one or several stamping means of the abovementioned type.

The embodiment according to FIGS. 3, 3*a*, and 3*b* is thus provided with two stamping means. For this reason the displaceable tool part 5', is provided with the first slot 7, which extends into the tool part from one side thereof and a second slot 7', which extends from the other side of the tool part and is situated axially outside of the first slot 7. A through drilling 8 and 8' respectively, is arranged at right angles to each slot 7 and 7' respectively. These two drillings 8, 8', are formed in the same manner as the earlier described drilling 8, and each cooperate in the above-stated manner with a plunger 12, 12', respectively. The drillings 8, 8', have preferably different forms, sizes and/or distances from the base of the cooperating slot 7 and 7', respectively. In this embodiment, the stationary tool part 4', suitably consists of an element comprised of a base plate 15, having a central hole for the piston rod and an axial flange 16 surrounding the displaceable tool part 5'. The axial flange 16 is provided with an axial slot 16', intended to receive a screw which is screwed into the displaceable tool part 5', and holds the tool parts 4' and 5' together, but allows the axial displacement. The compression springs 14, 14', which cooperate with the plungers 12, 12' are preferably arranged in counterbores of the through drillings 8 and 8', respectively.

The embodiment having two stamping means according to FIGS. 3, 3*a*, and 3*b* can be provided with a device for the adjusting of the desired distance from the edge. This adjustment device consists of a U-shaped yoke 17, which is arranged in such a manner on the tool 1, that the transverse portion thereof engages the outer end surface of the tool and is adjustably retained on same by means of a lock-screw 18 which extends through an elongated slot 30 in yoke 17. The shanks 19, of the yoke extend along the side surfaces of the tool beyond the two slots 7,7', so that the opposite edges 19*a* and 19*b* of the shanks 19, form check means for the plate edge inserted in each slot 7,7'. By displacement of the yoke 17, after loosening the lock-screw 18, the desired distance from the edge can be selected. This selection is simplified by means of an index scale arranged on the displaceable tool part 5'.

The embodiment shown in FIGS. 4 and 4*a* is meant for four stamping means. By this embodiment the displaceable tool part is formed as a cylindrical head 5'' having a slot 7'' which extends all around the head and in which the metal plate can be inserted. The slot 7'', extends in to a square central portion 20, the four sides of which form abutment surface for the inserted plate edge. A through drilling 8'', corresponding to the abovementioned drilling 8, is arranged in the displaceable tool part 5'' opposite each side of the centre portion 20. Each of these drillings 8'', are formed in the earlier stated manner and cooperate with a perspective plunger 12''. At the end facing the driving motor, the head 5'' is provided with an axial ring flange which surrounds the stationary tool part 4'', having the form of a circular disc. A circlip 16 engaged in an annular groove holds the tool parts 4'' and 5'' together so that the tool as a unit can be attached to and released from the driving motor 2.

The circlip 16'' holds the movable and stationary tool parts 5'' and 4'' together but allows axial displacement between them. In FIGS. 4 and 4*a*, as in the embodiments shown in FIGS. 1 and 2 and FIGS. 3, 3*a*, and 3*b*, and described for FIGS. 1 and 2, the driving motor has a piston rod 3 which is screwed into a central threaded drilling in the movable tool part 5''. The stationary tool part 4'' abuts against the flat end surface of the motor cylinder, and the compression springs which surround the plungers 12'' hold the tool parts 5'' and 4'' in the position shown in FIG. 4. In this position, a plate edge can be inserted into slot 7'' and into engagement with a side of square central portion 20 which surrounds the central threaded drilling.

When the driving motor is actuated, the piston rod draws the movable tool part 5'' inwardly against the stationary tool part 4'' against the force of springs 14. This causes the plungers 12'', through their end surfaces which engage the stationary tool part 4'', to be pressed into slot 7'' to stamp a hole in the plate edge.

Figure 1:
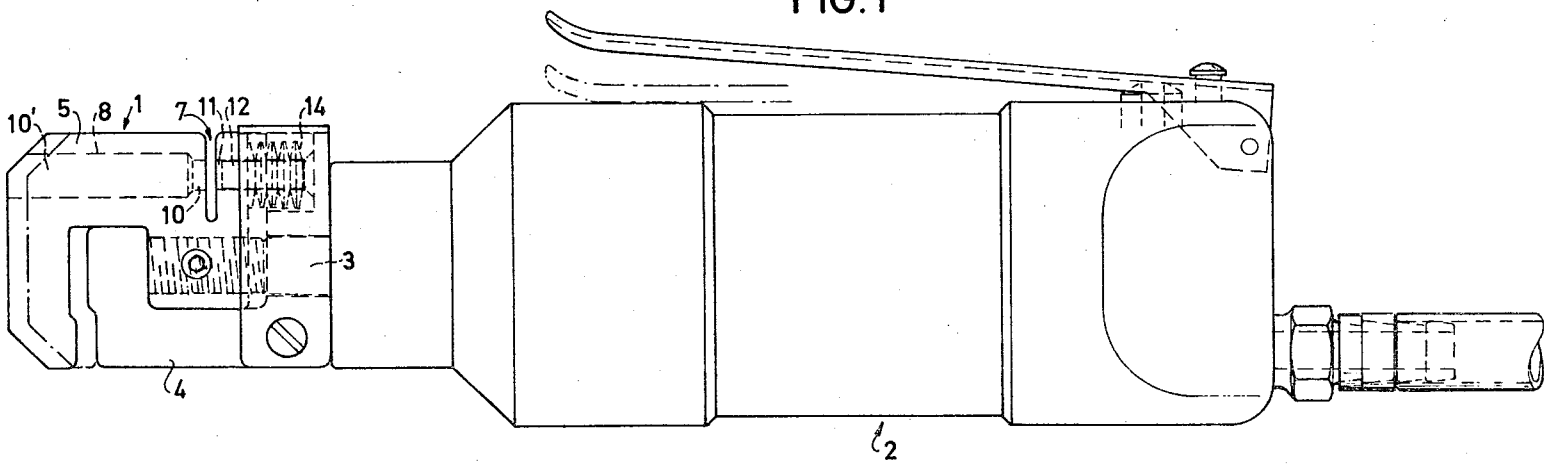
Figure 2:
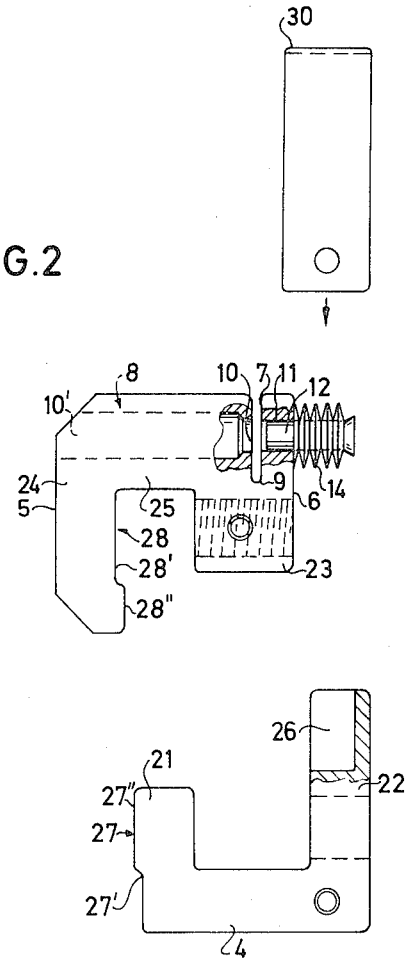
FIG. 2 is an exploded view of the tool according to FIG. 1.

The embodiment of the tool according to the invention which is shown in FIGS. 1 and 2, has a somewhat modified construction and is meant to make it possible to permanently deform the edge of a plate besides stamping holes therein.

In this embodiment, the stationary tool part 4, consists of a U-shaped yoke having a shorter shank 21 and a longer shank 22, the outwardly turned side face of the latter engaging the end surface of the motor cylinder and having a hole in which the piston rod 3 is freely movable. The displaceable tool part 5 also consists of a U-shaped yoke having a shorter shank 23 and a longer shank 24. When the tool is assembled, the parts 4 and 5 thereof are so placed that the shorter yoke shank 23 of the displaceable tool part 5 is inserted between the two yoke shanks 21 and 22 of the stationary tool part 4. The shorter yoke shank 21 of the stationary tool part 4 is thus situated between the two yoke shanks 23 and 24 of the displaceable tool part 5.

A stamping means of the design mentioned above is arranged in the displaceable tool part 5. The slot 7, of this stamping means, thereby extends inwardly from the back side of the yoke 5 forming the displaceable tool part directly opposite to the shorter yoke shank 23 thereof, and the drilling 8 of the stamping means is arranged in the transverse portion 25 of said yoke 5 in the longitudinal direction thereof. The displaceable plunger 12 arranged in said drilling 8, protrudes outside of the outer side of the shorter yoke shank 23 of the displaceable tool part 5 and the one end of the compression spring 14 which surrounds the plunger is in engagement with said outer side. The outer side of the longer yoke shank 22, of the stationary tool part 4 is provided with a recess 26 which is open at the inner side and outer end of said yoke shank 22. Said recess 26 is arranged to receive the portion of the plunger 12 protruding out from the displaceable tool part 5 and the compression spring 14, the end surface of said plunger 12 engaging the base of the recess 26.

The side faces 27 and 28, of the shorter yoke shank 21 of the stationary tool part 4, and the longer yoke shank 24 of the displaceable tool part 5 which face each other, are situated at such a distance from each other that a plate edge to be treated is insertable between said side faces when the motor 2 is not actuated. The side faces 27,28 are furthermore so formed that they, upon displacement towards each other during a working stroke, cause a plastic deformation of the intermediate plate edge. In the embodiment shown, the side faces 27, 28 are intended to provide a joggling of the edge of the plate. The side face 27 of the shorter yoke shank 21 of the stationary tool part 4 is therefore of stepped form with an outer recess portion 27' and an inner raised portion 27''. The side face 28 of the shorter yoke shank 24 of the displaceable tool part 5, has a corresponding stepped form with an inner recessed portion 28' and a raised outer portion 28''. By moving the tool along the plate edge and simultaneously performing repeated working strokes, the plate edge can be provided with joggling preferably of such a depth that a second plate pressed against the joggled edge in known manner has its outer surface flush with the outer surface of the joggled plate. Should holes have been stamped in the edge of one of the plates by the aid of the stamping means of the tool, the two plates can be connected through welding or soldering in the stamped holes.

The parts of the tool according to FIGS. 1 and 2 are held together by means of a U-shaped plate clamp 30, the shanks of which extend along opposite side faces of the longer yoke shank 22, of the stationary tool part 4, and are secured thereto by means of screws. The transversed portion of the plate clamp 30 thereby engages the outer portion of the back side of the displaceable tool part 5 at its shorter yoke shank 23, and extends out over the protruding portion of the plunger 12 and the compression spring to close the recess 26 in the stationary tool part 4. The tool parts 4 and 5 therefore cannot be moved apart in the plane of the yoke shanks and are effectively guided during the axial relative movement.

The embodiments of the tool according to the invention mentioned above must only be regarded as examples without any limiting effect. Several modifications can be made without departing from the idea of the invention defined in the attached claims. The described stamping means need not thus be intended for the stamping of holes but can be designed to provide notches in the edges of metal plate. The tool portion intended for performing the plastic deformation need not either be intended for joggling but can be adapted for other plastic deformation, e.g. countersunk indentations of the metal plate around a hole provided by means of a stamping means.

What I claim is:

1. A tool for the stamping of holes or the like in sheet material, such as metal plate, said tool being intended for use in combination with a fluid actuated piston and cylinder motor, preferably with a motor which can be held in the hand, and is comprised of a stationary part which is supported against the motor cylinder and a displaceable part which can be connected to the piston of the motor, characterized in that the displaceable tool part is provided with at least one slot at right angles to the direction of the stroke of the motor, in which the metal plate is insertable into engagement with a base thereof, and a through drilling which extends through the slot at right angles to same and at a distance from its base, the portion of the drilling on the side of said slot remote from said motor being formed as a stamping die and the portion thereof between said slot and said motor being formed to accommodate an axially displaceable plunger, the inwardly turned end of which abuts against the stationary tool part in such a manner that the plunger, upon displacement of the piston away from the tool is forced into and through the metal plate therein.

2. A tool according to claim 1, characterized in that the plunger is displaceable into the slot against the action of a compression spring.

3. A tool according to claim 2, characterized in that the compression spring is made up of a packet of spring washers which are inserted between the displaceable tool part and a shoulder at the inwardly turned end of the plunger.

4. A tool according to claim 1, characterized in that it includes two slots which penetrate from opposite sides and are arranged at a distance from each other in the direction of the stroke of the tool and each cooperates with a through drilling accommodating a plunger.

5. A tool according to claim 1, characterized in that the slot extends around the whole periphery of the tool up to a polygonal central portion of the displaceable tool part and that a through drilling accommodating a plunger is arranged opposite each side of said polygonal central portion.

6. A tool according to claim 5 characterized in that said through drillings with cooperating plungers are arranged at different distances from the base of the cooperating slot and from the cooperating side of the central portion, respectively, and have different diameters.

7. A tool according to claim 1, characterized in that the displaceable tool part preferably at the side turned away from said slot, is provided with a cut out which is broad in comparison with said slot, and that the stationary tool part is formed with a shoulder protruding into said cut out, said cut out and shoulder having faces which are turned towards each other and extend substantially at right angles to the stroke direction of the motor, said faces, in the unactuated condition of the motor, being spaced at a sufficient distance from each other to accommodate the metal plate and being formed to permanently deform the intermediate metal plate during the working strokes of the motor.

* * * * *